United States Patent [19]

O'Rourke et al.

[11] Patent Number: 4,766,681

[45] Date of Patent: Aug. 30, 1988

[54] ATHLETIC SHOE WITH Y SUPPORT

[75] Inventors: John J. O'Rourke, Weston; Richard P. Bunch, Reading, both of Mass.

[73] Assignee: Converse Inc., Worcester, Mass.

[21] Appl. No.: 120,749

[22] Filed: Nov. 9, 1987

Related U.S. Application Data

[63] Continuation of Ser. No. 36,986, Apr. 10, 1987, abandoned, which is a continuation of Ser. No. 735,081, May 16, 1985, Pat. No. 4,676,011.

[51] Int. Cl.[4] ..... A43B 7/20; A43B 7/14

[52] U.S. Cl. ..... 36/89; 36/114; 36/50; D2/309; D2/312

[58] Field of Search ..... 36/114, 50, 51, 88–89, 36/58.5, 45, 58.6; 128/80 H; D2/309, 310, 312, 313

[56] References Cited

U.S. PATENT DOCUMENTS

| | | | |
|---|---|---|---|
| 459,616 | 9/1891 | VonRohonezy | 36/89 |
| 1,155,506 | 10/1915 | Osaki | 36/89 |
| 3,138,880 | 6/1964 | Kunzul | 36/114 |
| 4,282,657 | 8/1981 | Antonious | 36/114 |
| 4,308,672 | 1/1982 | Antonious | 36/50 |
| 4,366,634 | 1/1983 | Grese et al. | 36/114 |
| 4,676,011 | 6/1987 | O'Rourke et al. | 36/89 |

FOREIGN PATENT DOCUMENTS

| | | | |
|---|---|---|---|
| 47710 | 3/1982 | European Pat. Off. | 36/114 |
| 149573 | 7/1985 | European Pat. Off. | 36/114 |
| 296552 | 2/1917 | Fed. Rep. of Germany | 36/58.5 |
| 827130 | 4/1938 | France | 36/89 |
| 2527427 | 12/1983 | France | 36/89 |
| 4364 | 1/1916 | United Kingdom | 36/89 |
| 2134769 | 8/1984 | United Kingdom | 36/58.5 |

*Primary Examiner*—Steven N. Meyers

*Attorney, Agent, or Firm*—Bromberg, Sunstein & Casselman

[57] ABSTRACT

An athletic shoe employs a pair of spring structures in such a way that an arm of a Y-shaped spring on one side of the ankle fastens under tension to a corresponding arm of a spring on the other side of the ankle. The springs are preferably of sheet material conforming to and affixed to the upper. The two springs may be formed as a wrap-around single member.

3 Claims, 4 Drawing Sheets

ATHLETIC SHOE WITH Y SUPPORT

This is a continuation of co-pending application Ser. No. 036,986 filed on Apr. 10, 1987, now abandoned, which is a continuation of application Ser. No. 735,081, filed May 16, 1985, now U.S. Pat. No. 4,676,011.

DESCRIPTION

TECHNICAL FIELD

The present invention relates to athletic shoes, and more particularly to construction of athletic shoe uppers, especially for basketball and other sports involving strenuous motions of the foot relative to the leg.

BACKGROUND ART

Modern basketball shoes are required to be both light weight and extremely flexible because of the range and speed of motions arising in use. An example of basketball shoe design is shown in U.S. Pat. No. DES 262,751 issued to Wolf Anderie. That shoe includes a high top upper having a cushioning portion commencing just below the ankle and extending over the lower portion of the leg at the ankle opening. Various other constructions are known in the art, ranging from an essentially unitary sheet panel covering the entire upper portion of the shoe, to diverse arrangements of textile sheet portions and leather reinforcement portions so as to firmly accommodate the foot while allowing a proper distribution of stresses within. A common need of all such designs is to provide adequate support to the foot of the wearer so as to prevent sprains which can result from excess movement of the various joints of the foot from their normal orientation. As a practical matter, this end cannot be fully achieved because of the trade-off between shoe flexibility and weight, on the one hand, and the shoe's ability to provide full support, on the other hand. Thus, athletes generally tape their feet to provide additional support when playing strenuous games.

Various support structures for shoes or boots generally are known, such as the spring structures shown in U.S. Pat. No. 450,698 issued Apr. 21, 1891, for an invention of Saunders; the stays shown in U.S. Pat. No. 325,280 issued Sept. 1, 1885, for an invention of Smadbeck, et al., and the brace structures, such as shown in U.S. Pat. No. 1,441,677 issued Jan. 9, 1923, for an invention of Golden. In addition, strap structures are known in substantially rigid athletic shoes such as ski boots and ice skates, as shown in French Patent No. 827,130 published Apr. 25, 1938, for an invention of Selinger. Finally, it is known to provide an ankle support formed of spring material and rising vertically from the sole with a cut-out over the ankle bone for a tall shoe or boot, as shown in U.S. Pat. No. 534,179 issued Feb. 12, 1895, for an invention of Sessler. While the foregoing patents show generally the use of stays, springs and straps to more firmly hold the foot in a given position, restrain excessive motion, or provide additional support, they do not appear to show any awareness of a combination of strap and spring elements to provide a lightweight supporting structure for a flexible high top shoe.

DISCLOSURE OF THE INVENTION

According to the present invention, a sport shoe is provided with a leg stabilization structure. Lateral and medial sheet portions substantially form the upper, and the stablization structure includes first and second sheet springs conformally affixed to the lateral and medial sheet portions respectively. Each spring has a Y shape with a vertical strip portion extending upward from the region of the midsole and forking at approximately the level of the ankle into a forward sloping and a rearward sloping arm strip portion. An arm strip portion is fastened to the corresponding arm of the other sheet spring so as to form a collar under tension for inhibiting displacement of the leg in the region of the ankle. The Y shaped spring elements are formed of a stiff sheet spring material which resists twisting or deflection from its axis, does not stretch or compress appreciably, and bends, but does not buckle under the deformations encountered in use. The sheet spring material is affixed to the sheet side portions of the upper, so as to receive the stresses thereof and distribute its support thereto. In a preferred embodiment, the fork of each Y arm is approximately centered over the malleolus of the foot. In a further preferred embodiment, a strap fastens the forwardmost portion of the forward sloping arm to the corresponding portion of the forward sloping arm on the opposing side of the shoe. In another embodiment, the rearward facing arms of each side extend and join each other around the heel region so as to form a unitary member, which may be made in one piece. Lace reinforcement panel or other means are provided for connecting under tension the front arms of the unitary structure so as to provide a collar supported by the vertical members of the Y on each side. A collar of cushioning material may be provided in the upper above the Y structure, and internal supporting structures, in the nature of elastic gores or ankle girdles may be provided.

BRIEF DESCRIPTION OF THE DRAWINGS

These and other features of the invention may be better understood by reference to the drawings, in which.

DESCRIPTION OF SPECIFIC EMBODIMENTS

Figure 1:
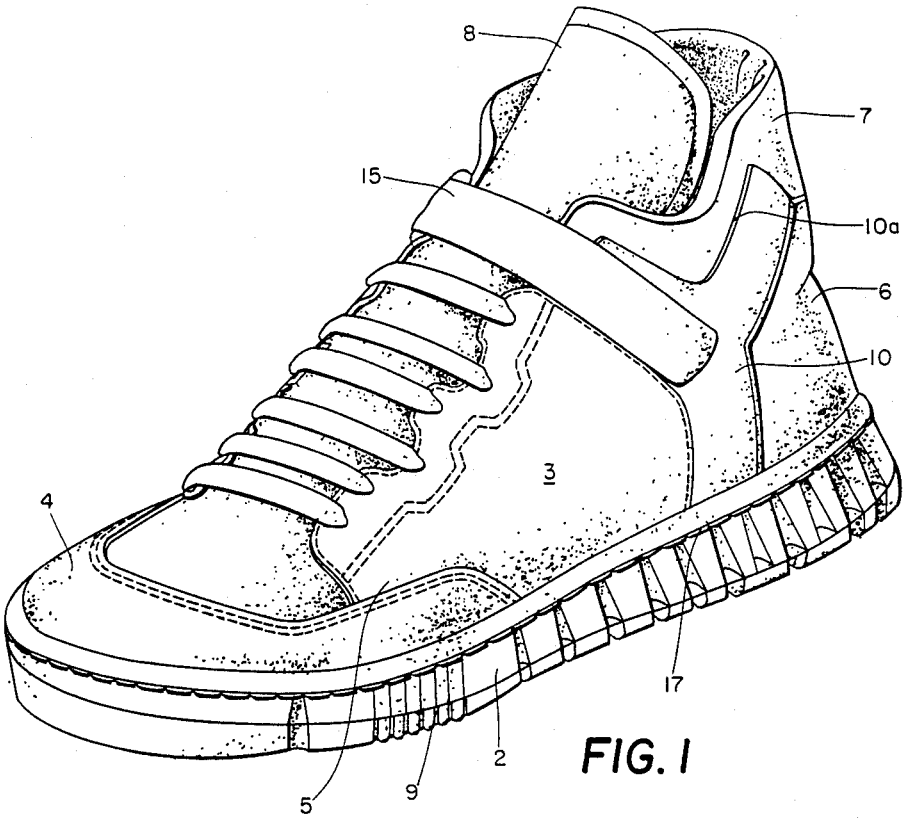
FIG. 1 is a perspective view of a shoe in a preferred embodiment of the present invention.

FIG. 1 shows a perspective view of a shoe 1, in a preferred embodiment of the present invention, showing a sole 2, upper 3 and subsidiary panels and components, including a toe reinforcement panel 4, lateral saddle panel 5, counter panel 6, cushioned collar 7, and padded tongue 8. Sole 2 includes a toe bumper portion 9 adapted to withstand impact in the region of the front flex line of the shoe. The upper is bonded to the sole structure, and stitched to the sole along seam 17, in a manner well understood in the art. Also shown is a Y-shaped support member 10, which comprises a thin flexible spring sheet, of which the edge is visible at 10*a*, one such support member being disposed on either side of the upper over the malleolus ankle bone.

Support member 10 has a lower vertically-oriented spring strip, which forks in the region of the malleolus, into a forward-sloping arm strip and a rearward sloping arm strip. Strap 15 interconnects the respective forward arm strips of the medial and lateral side Y-shaped support members over the top region of the instep. In the embodiment shown, support member 10 is formed of a sheet spring material, which may, for instance, be a spring steel but is preferably a plastic material, such as a nylon-type polymer, which is resistant to both bending and twisting out of its plane, and is relatively unstretchable and incompressible in such plane. Support member 10 is stitched along seam 17 to assure proper vertical registration; member 10 may also be stitched along its perimeter to the panels 5, 6 and cushion 7, or may be located within a pocket formed of leather or other suitable material. In either case, member 10 is conformally attached to or confined within the upper, so as to receive the stresses active on, and impart its support to, a substantial sheet region of the upper. This construction will be further discussed below, in relation to FIGS. 5–7 and 8–9.

Figure 2:
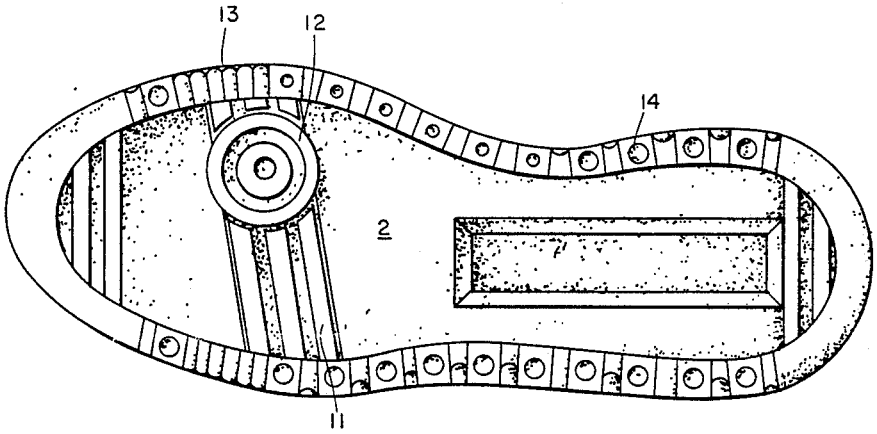
FIG. 2 is a bottom view of the shoe of FIG. 1.

FIG. 2 shows a bottom view of sole 2, having peripheral traction elements 14, a pivot point 12, and traction bars 11 arrayed along the front flex line of the shoe. Flex cleats 13 underly the toe bumper 9 of FIG. 1 and facilitate flexing of the shoe.

Figure 3:
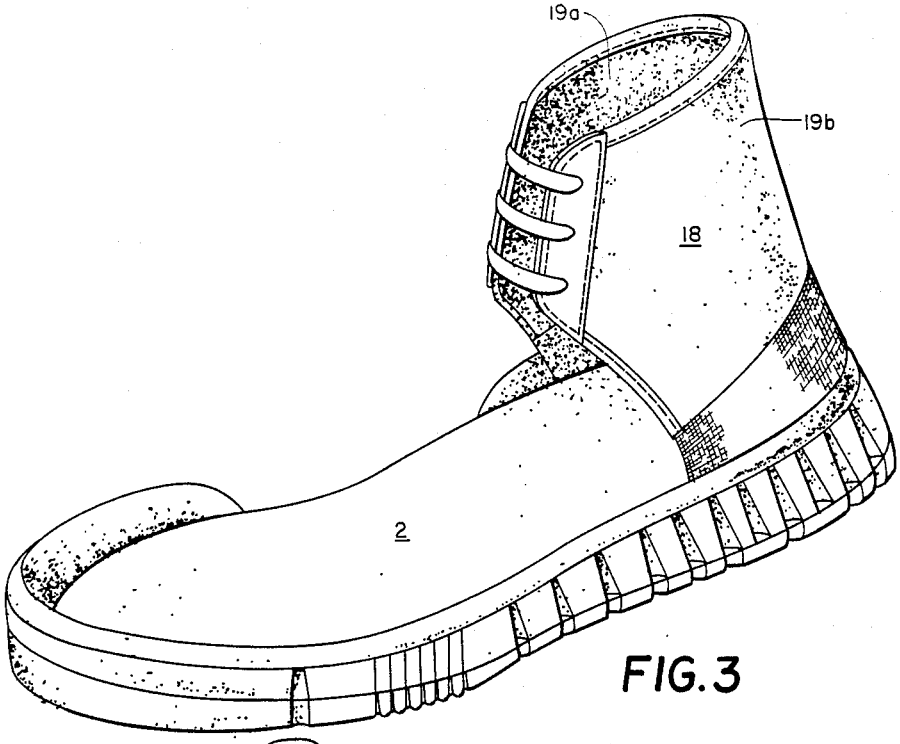
FIG. 3 is a view of an inner ankle corset in the shoe of FIG. 1.

FIG. 3 shows a view of the shoe of FIG. 1 with the upper cut away, revealing an inner ankle corset 18. Corset 18 comprises an inner sheet **19*a* which anchors below the heel, forming a generally collar-shaped corset around the region of the ankle and lower leg. Outer sheet 19*b* overlies inner sheet 19*a* in the upper region thereof, and cushioning material may be included between the sheets. The corset is provided with laces for closing it at the top portion thereof around the lower leg. Sheet 19*a*** is pliable but relatively unstretchable, so that while the construction can accommodate vertical motion of the leg in a downward direction, it will resist any tilting of the leg forward which would result in stretching. The inner collar thus accommodates a range of motion within the upper while providing restraint against excessive joint rotation. Also, since the corset travels freely with the foot, it prevents rubbing of the wearer's tendon area against the shoe; any motion of the foot within the shoe results in rubbing of the corset against the upper, rather than against the skin.

Figure 4:
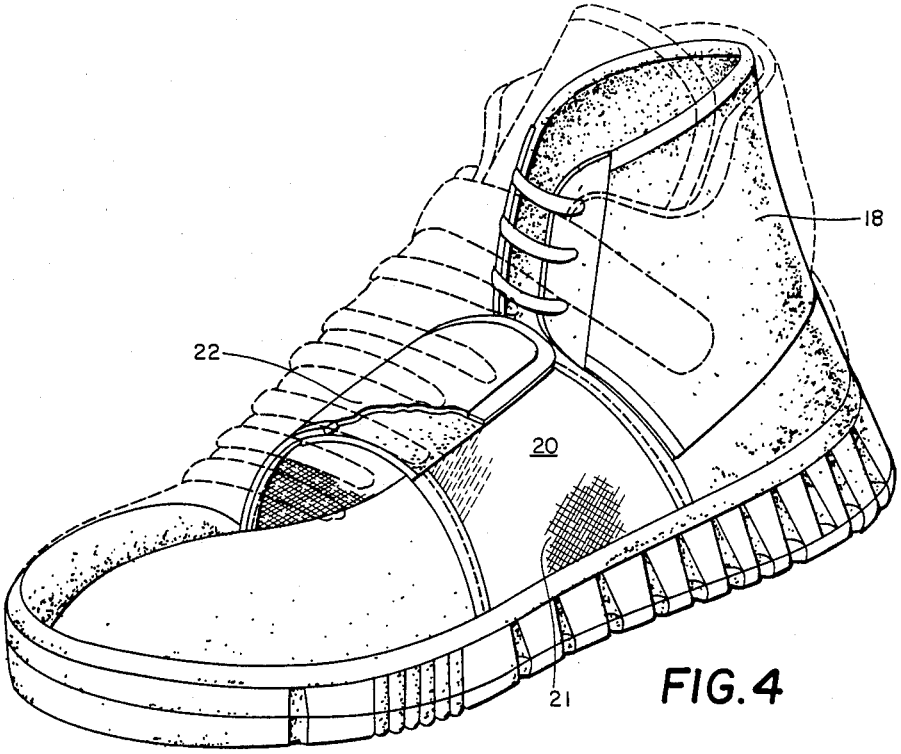
FIG. 4 is a view of an inner elastic saddle member and ankle corset in the shoe of FIG. 1.

FIG. 4 shows the structure of FIG. 3, as incorporated into the shoe of FIG. 1 and further showing inner saddle member 20. The upper is shown in phantom. Saddle member 20 includes first side member 21 and opposing side member 22 each formed of stretchable elastic material and mounted at the base of the foot. Sides 21 and 22 fasten together over the top surface of the instep with a relatchable hook-and-pile-type fastening. Saddle member 20 covers the instep region of the foot and serves to maintain the tarsus-metatarsus region of the foot securely anchored in the shoe. Collectively the separate restraint structures provided by corset 18 and the elastic saddle member 20 serve to preserve the orientation of the foot relative to the sole, so that an upper of greater flexibility, for example a slip-lasted upper, may be used.

Figure 5:
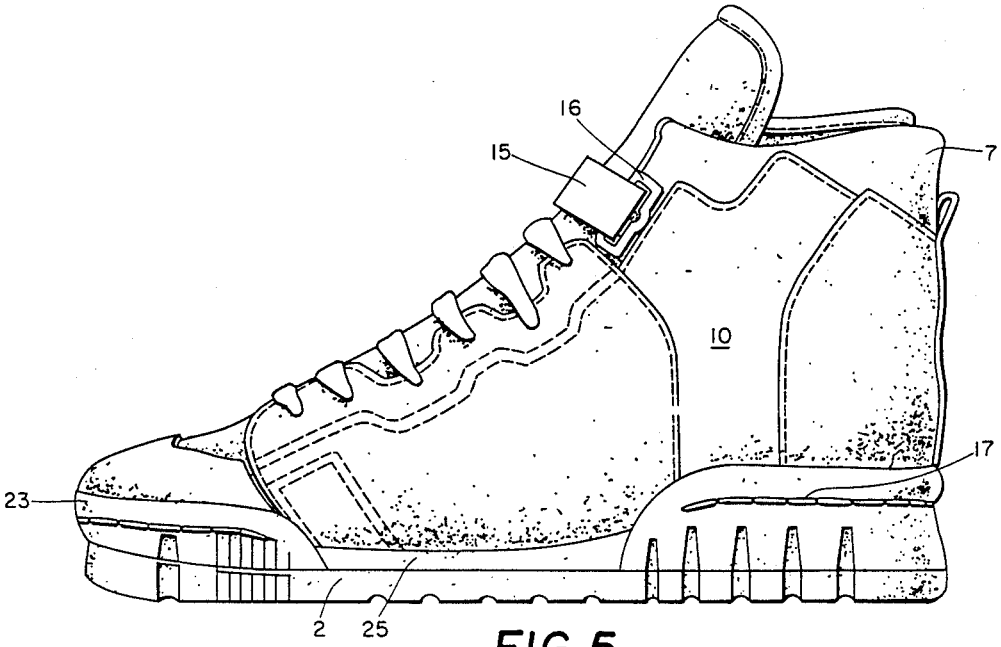
FIG. 5 is a medial side view of the shoe of FIG. 1.

Turning now to FIG. 5, there is shown a medial side view of the shoe of FIG. 1, with the support member 10, contained in an inner pocket, and shown in phantom. This "pocket" construction is a preferred embodiment of the Y-support structure, with the member 10 both adhesively bonded to the pocket and stitched along seam 17. A fastening ring 16, which may be integrally formed with member 10, engages strap 15 so as to direct the tension of the fastening means along the front arm of the Y structure. On the medial side, sole 2 preferably has a toe side wall 23 and a heel side wall 24, but excludes an intermediate midfoot wall portion, so as to provide a relatively supple and flexible sole structure. One or more cushion wedge layers 25 are provided above the ground-contacting surface of the sole.

Figure 6:
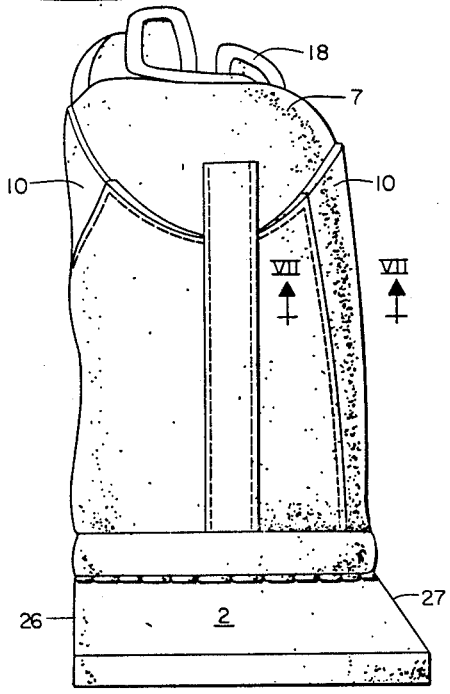
FIG. 6 is a rear view of the shoe of FIG. 1.

FIG. 6 shows a rear view of the shoe of FIG. 1, with support members 10 disposed in the ankle region on either side of the shoe. Sole 2 is preferably flared, with medial side wall 24 flaring approximately 0°–5° outward from the vertical, and the lateral side 26 more substantially flared, in the range of approximately 6°–12° from the vertical.

Figure 7:
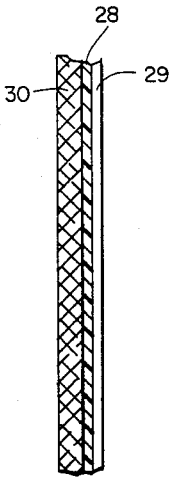
FIG. 7 is a section through the shoe of FIG. 1.

FIG. 7 shows a section through the support member 10 along the line VII—VII of FIG. 6. As shown, spring layer 28 is covered by outer layer 29, which may be for instance a thin leather, and by inner layer 30, which may be a thick leather. Alternately, the outer layer may be a thick layer and the inner layer a thin layer.

Figure 8:
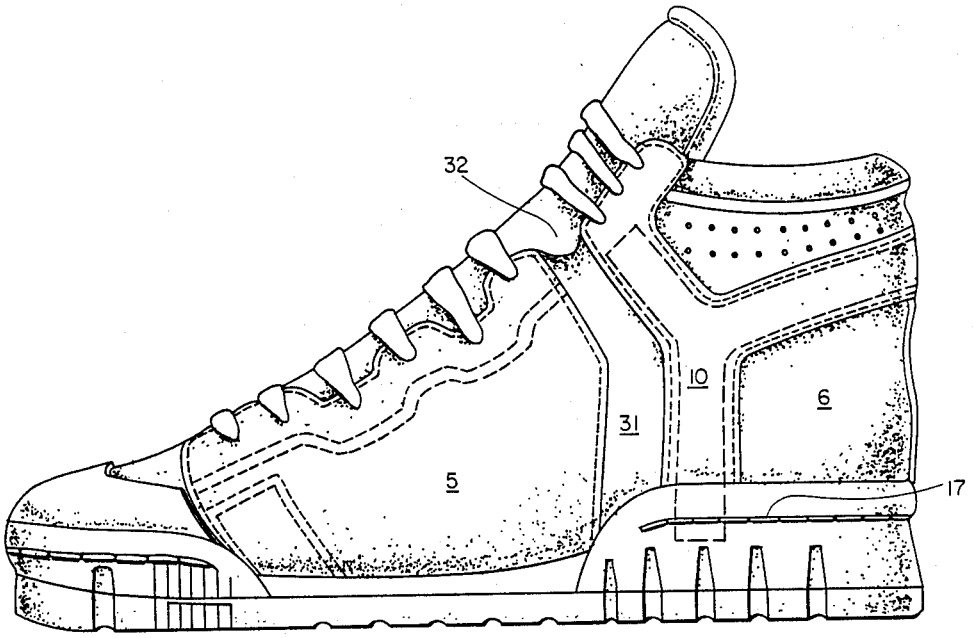
FIG. 8 is a medial side view of another preferred embodiment of the invention.
Figure 9:
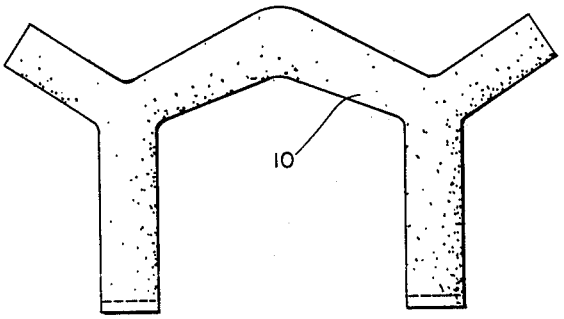
FIG. 9 is a view of the support member of the shoe of FIG. 8.

FIG. 8 shows another embodiment of a shoe using the invention. In this embodiment support member 10, shown in phantom, is covered by a panel 33. The rear arm of member 10 exends around the heel, joining the rear arm of a corresponding member 10 symmetrically located on the other side of the shoe. In this embodiment, preferably the two support members 10 are formed as a single piece, shown in FIG. 9, as is the cover panel 33. At the front end of the forwardly sloping arms an upward extension of panel 33 accommodates a plurality of lacings to fasten the forward arms together under tension. In this manner the double support member 10 of FIG. 9, together with counter panel 6, cover panel 33 and the laces, provides a cage-like structure entirely surrounding the ankle opening and inextensibly anchored to the sole in the heel region. This embodiment of the invention has a saddle panel 5, of relatively strong leather, which is separated from the just-enumerated cage structure by band 31 of a more flexible material, so that the shoe may flex at a break line 32 of the upper between the instep and the leg. Preferably, this embodiment of the shoe is combination lasted, with a lasting board extending toward the front of the arch area, and the shoe includes an inner elastic saddle member similar to 20 of FIG. 4.

It will be appreciated that the preferred embodiments of the invention have been illustrated in shoes having inner saddle and ankle corset structures, but that these structures are not necessary to the practice of the invention. While, for example, the spring structures have been described in terms of sheet material, the preferable features of the spring structure are that the vertical portion resist compression in its plane, and all portions resist stretching can resiliently inhibit twisting and deflection from their nominal orientation. Thus, for instance, a structure of spaced apart springy rods in a Y-shaped unit, suitably mounted to conform to the sheet of the upper, is also within the invention.

What is claimed is:

1. An improved athletic shoe of the type having an outsole, a midsole and an upper, wherein the upper is formed with lateral and medial side sheet portions having adjacent edges, and fastening means for fastening the lateral and medial side portions along a portion of the adjacent edges thereof together, wherein the improvement comprises: a structure, having first and second sheet springs, made of a material which is resistant to both bending and twisitng out of its plane, and is relatively unstretchable and incompressible in such plane, conformally affixed along substantially the entire perimeter thereof to the lateral and medial sheet portions respectively, and each spring having a Y shape with a vertical portion extending upward from the region of the sole and attached thereto directly below the region of the ankle and forking at approximately the level of the ankle into fore and rear arm portions; and means for fastening under tension the ends of the corresponding pair of fore arms so as to form a structure for inhibiting displacement of the ankle.

2. An athletic shoe according to claim 1, wherein the means for fastening under tension is a strap which fastens in a position approximately continuous with the arm strips so as to form, together with the arms, a substantially continuous band for inhibiting such displacement.

3. An athletic shoe according to claim 2, further including cushioning means, extending upward from the region of the arms, for protecting the leg from contact with the arms, and extending around the rear of the shoe to form a collar above the first and second spring structures.

* * * * *